US005388346A

United States Patent [19]

Liversidge

[11] Patent Number: 5,388,346

[45] Date of Patent: Feb. 14, 1995

[54] METHOD AND APPARATUS FOR DRYING CERAMIC WARE BY USE OF AIR JETS

[75] Inventor: David C. Liversidge, Blythe Bridge, United Kingdom

[73] Assignee: Rotajet Limited, Stroke-on-Trent, United Kingdom

[21] Appl. No.: 944,885

[22] Filed: Sep. 14, 1992

[30] Foreign Application Priority Data

Sep. 18, 1991 [GB] United Kingdom ..... 9119898

[51] Int. Cl.[6] ..... F26B 7/00

[52] U.S. Cl. ..... 34/438; 34/440; 34/105

[58] Field of Search ..... 34/103, 104, 105, 106, 34/107, 21, 217, 229, 437, 438, 439, 440

[56] References Cited

U.S. PATENT DOCUMENTS

| | | | |
|---|---|---|---|
| 2,501,367 | 3/1950 | Wehmiller et al. | 34/105 |
| 2,573,217 | 10/1951 | Parmelee | 34/105 |
| 2,589,088 | 3/1952 | Johnson | 34/105 |
| 2702,435 | 2/1955 | Pinney | 34/105 |
| 3,348,318 | 10/1967 | Norlyng | 34/105 |
| 3,777,407 | 12/1973 | Leisenberg | 34/105 |
| 4,173,079 | 11/1979 | Cruff et al. | 34/217 |

FOREIGN PATENT DOCUMENTS

| | | |
|---|---|---|
| 0108001 | 5/1984 | European Pat. Off. . |
| 2010198 | 9/1970 | Germany . |
| 2301680 | 7/1974 | Germany . |
| 2649189 | 6/1977 | Germany . |
| 3713517 | 11/1988 | Germany . |

*Primary Examiner*—Denise L. Gromada
*Attorney, Agent, or Firm*—Smith-Hill and Bedell

[57] ABSTRACT

Apparatus for drying articles, especially ceramic articles comprises a mould (14) For supporting the article to be dried, a turntable (10) For supporting and rotating the mould and at least one nozzle (18) For directing heated air on to the article (12), especially near its periphery.

17 Claims, 3 Drawing Sheets

METHOD AND APPARATUS FOR DRYING CERAMIC WARE BY USE OF AIR JETS

The present invention concerns improvements in or relating to drying apparatus, especially but not exclusively apparatus for drying formed ceramic articles, for example, clay flatware and holloware, prior to final firing.

Clay flatware and holloware is often moulded on a porous former or mould and prior to firing at elevated temperature after being removed from the mould, it is dried to make it sufficiently firm to be handled, the drying process involving the evaporation of moisture from within the clay body. Glazing techniques also call For the drying of the glaze, prior to firing, by evaporation.

Drying techniques must be carefully controlled to ensure that the clay body does not crack due, for example, to differential thermal expansion across its width or to differential drying. As a result of this relatively critical step apparatus employed heretofor has either been complicated and consequently expensive or alternatively the drying has been gradual, involving placing articles to be dried within a kiln or drier for a considerable period of time. As a result of this, when large quantities of materials have to be dried, large capacities or several dryers are required. Clearly this is disadvantageous and an object of the present invention is to obviate these and other disadvantages inherrent in prior drying methods and apparatus.

According to the present invention there is provided a method of drying an article of clayware comprising directing at least one jet of air onto the article at a predetermined pressure and temperature while the article and the jet are rotated relative to each other.

The jet or air may be directed onto the article at above ambient pressure and at ambient or above temperature.

The invention is particularly suitable for drying an article of ceramic material.

Preferably the jet is directed at or near the periphery of the article. An additional jet or jets may be directed at other areas of the article.

Preferably the article remains supported on a mould while it is being dried.

Preferably, the article is rotated relative to the jet. The article may be rotated at speeds of between 2 and 16 revolutions per minute. In an alternative embodiment, the jet is rotated relative to the article.

Preferably the temperature of the jet of air directed onto the article lies within the range ambient to 300° C., its velocity lies within the range 0.25 m/sec to 20 m/sec, its supply pressure lies within the range 50 kg/m$^2$to 350 kg/m$^2$ and the angle of the jet relative to the axis of rotation lies within the range 10° to 65°.

Further according to the present invention there is provided drying apparatus for ceramic ware supported on a mould, comprising a turntable for supporting the ware, means for rotating the turntable and means for directing a jet of air at a predetermined temperature and pressure onto said article.

The means for directing the jet of air may be such as to direct the jet at above ambient pressure and at ambient or above temperature.

Preferably a mould is provided to support the article on the turntable.

Preferably a plurality of nozzles are provided at spaced locations. Preferably at least one nozzle directs a jet of air onto the periphery of the ware. The nozzle(s) may have a circular or rectangular outlet.

Preferably a plurality of turntables are provided on an endless conveyor passing below a plurality of nozzles arranged along the length of the conveyor in mutually spaced relationship.

An embodiment of the present invention will now be described by way of example only with reference to the accompanying drawings in which.

Figure 1:
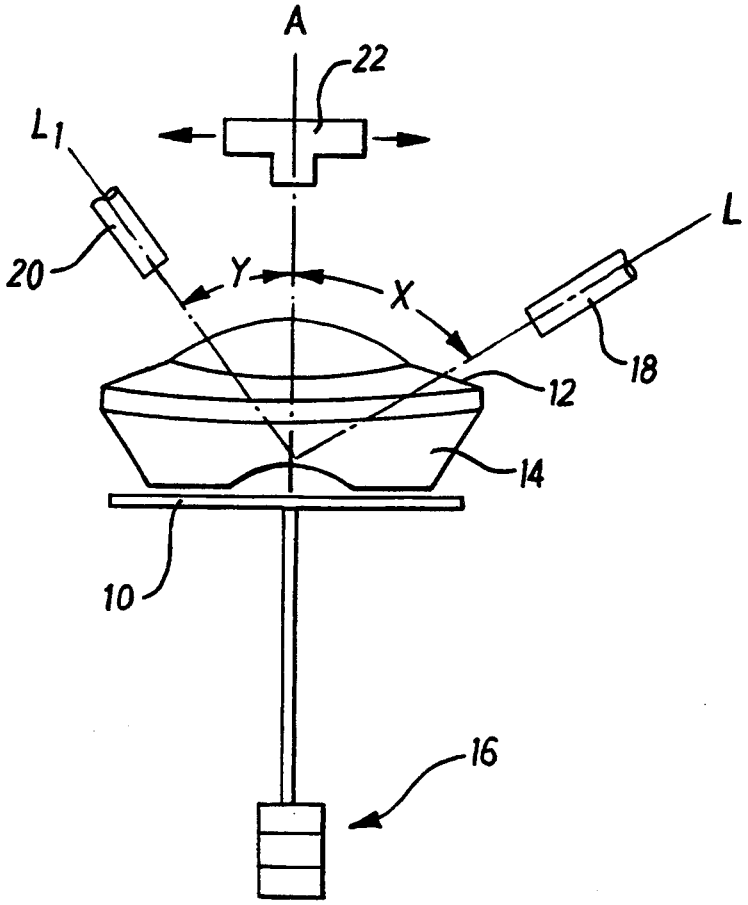
FIG. 1 shows diagrammatically a drying apparatus.

A drying apparatus for a clay flatware or holloware article is shown diagrammatically in FIG. 1 and is used immediately after moulding the article. It comprises a rotatable turntable 10 on which is supported the article 12 while still supported on its plaster mould 14. Means 16, which are only shown diagrammatically in the drawing, are provided for rotating the turntable at a relatively low speed for example between 2 and 16 rev/min. Mounted above the turntable and directed in the general direction of the periphery of the article is a first nozzle 18 for directing a supply of air at above atmospheric pressure and temperature onto the article to be dried as it is rotated by the turntable. The nozzle is arranged such that the angle X of its discharge axis L relative to the axis of rotation A is in the range 10° to 65° . The nozzle shape comprises a circular or rectangular cross-section outlet having an area lying within the range 500 mm$^2$ to 8000 mm$^2$. The nozzle discharge velocity lies within the range 10 inches/second to 800 inches/second and the pressure of the air supplied thereto lies within the range 50 kg/m$^2$ to 350 kg/m$^2$. Also arranged above the article and approximately centrally thereof is an exhaust duct 22 connected to an air extract/on system which does not form part of the present invent/on and consequently will not be described in detail.

At least one other nozzle 20 can be arranged above the article .being dried at an angle Y to the axis A of rotation angle Y lying within range 10° to 45°. This further nozzle is directed at an area of the article different from that onto which the jet from the first nozzle 18 is directed. Its shape is similar to that of nozzle 18 described above and the discharge velocity therefrom etc., lies within the same range as that for nozzle 18.

In operation, an article to be dried is placed on the turntable 10 which is rotated at a speed of between 2 and 16 rev/min. A jet of heated air at a temperature of between ambient and 300° C. is supplied by the first nozzle 18 onto the periphery of the article 12. Air at similar conditions is directed onto another inner area of the article by the further nozzle 20. The air extraction apparatus including the exhaust 22 is actuated so that moisture laden air from the article being dried, is extracted from the drying apparatus, often to be re-cycled after removal of moisture therefrom.

Figure 3:
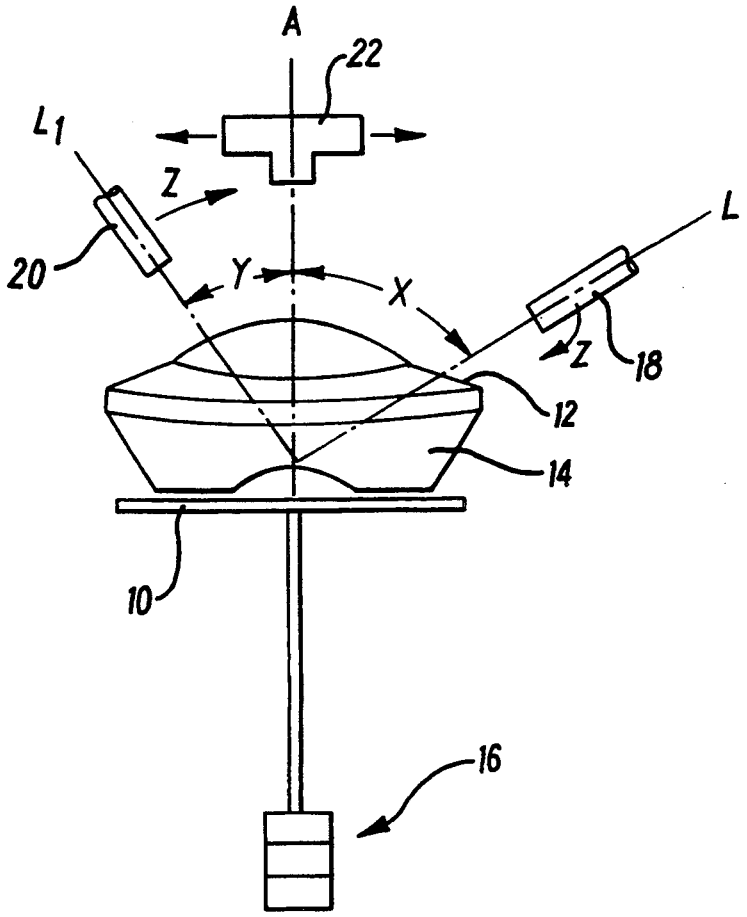
FIG. 3 is a view of a drying apparatus similar to FIG. 1 but in which the jets rotate.

In an alternative embodiment, the article 12 is not rotated but the jets 18, 20 are rotated about the article as shown by the arrows Z in FIG. 3.

The drying temperatures involved are considerably in excess of those currently employed and surprisingly, even at such elevated temperatures, the ware does not crack or distort nor is the mould damaged, probably as a result of the fact that it is rotated as it is being dried so that the applied heat is spread progressively from one point to the next. The choice of nozzle angle, positioning and discharge velocity permits rapid drying without damage, for example, cracking the article.

As a result of the elevated temperature, the specific control of direction of air and its preset velocity drying times can be considerably decreased, for example, experiments have shown that the drying time can be decreased by a factor of ten. When coupled with the knowledge that the ware and mould is not being distorted or cracked this represents a surprising and considerable saving.

Figure 2:
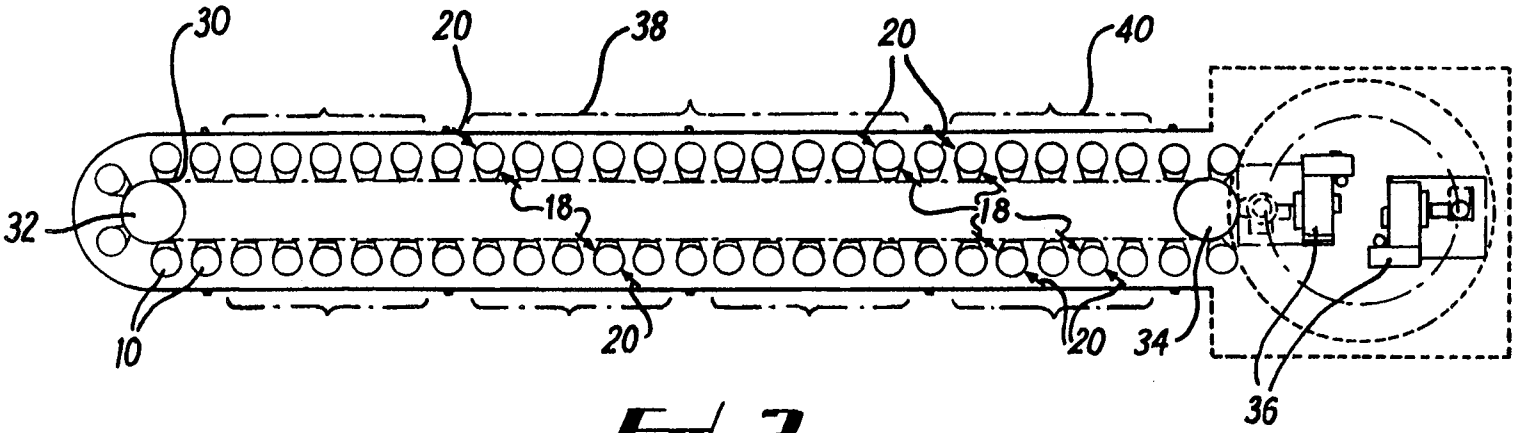
FIG. 2 show a diagrammatic plan of a continuous multi-station drying apparatus.

In an industrially applicable modification illustrated in FIG. 2 a plurality of turntables 10 are arranged at spaced intervals along the chain of an endless chain conveyor 30 moving between two sprockets 32, 34 (moulds with ware to be dried thereon are delivered automatically to the turntable from a flat manufacturing assembly 36 which does not form part of the present invention and consequently will not be described in detail here). Several other configurations are also possible to suit product and site restrictions.

Spaced along the length of the conveyor above the turntables are a plurality of nozzles 18, 20. Representative nozzles are shown schematically in FIG. 2. Alternatively the nozzles may move with the turntables along the path of the conveyor. The moist air extraction apparatus is preferably arranged at spaced intervals along the top of an enclosure (not shown) for the conveyor and above the conveyor over the central half 38 of the return run there are provided pulsed or constantly operating fans delivering heated air to the region of each turntable to increase the drying effect, this being possible because of the elevated temperature which the ware has, by now, achieved. An off-loading station 40 at the end quarter of the return run immediately adjacent to the flatware making machine 36 enables the ware and moulds to be off-loaded either automatically or manually.

Various other modifications can be made without departing from the scope of the invention, for example, a single jet may be employed or a plurality. In addition to the continuous apparatus illustrated in FIG. 2 it may be possible to arrange for an apparatus operating on the batch principal. Other nozzle shapes, positioning and discharge velocities can be employed and different speeds of turntable rotation can be utilised, depending upon the ware being dried. Additionally the apparatus will function equally efficiently on other vapour removal steps, for example, it can be employed advantageously to dry glaze applied to ware, prior to its firing. Whereas the invention finds particular application in the manufacture of ceramic ware the apparatus and method thereof is not confined to use with such ware.

I claim:

1. A method of drying an article of ceramic ware comprising supporting an article to be dried on a stage, directing at least one jet of air onto the article at a predetermined pressure and temperature and establishing relative rotation between the article and the jet about an axis passing through the article at speeds upwards of between two and sixteen revolutions per minute, wherein the temperature of the jet of air directed onto the article lies within the range ambient to 300° C., the velocity of the jet of air lies within the range 10 inches/-second to 800 inches/second, the supply pressure of the jet of air lies within the range 50 kg/m$^2$ to 350 kg/m$^2$ and the jet has an angle relative to the axis of rotation lying within the range of 10° to 65°.

2. A method as claimed in claim 1, wherein the jet is directed in the region of the periphery of the article.

3. A method as claimed in claim 2, wherein at least one additional jet is directed at other areas of the article.

4. A method as claimed in claim 1, wherein the article remains supported on a mould while the article is being dried.

5. A method as claimed in claim 1 wherein the article is rotated relative to the jet.

6. A method as claimed in claim 1, wherein the jet is rotated relative to the article.

7. Drying apparatus for drying an article of ceramic ware supported on a mould, the apparatus comprising a stage for supporting the ware, nozzle means for directing a jet of air toward an article supported on the stage at a predetermined temperature within the range ambient to 300° C., at a predetermined pressure in the range 50 kg/m$^2$ to 350 kg/m$^2$, and at a velocity in the range 10 inches/second to 800 inches/second, and means for establishing relative rotation between the article and the jet at speeds of between 2 and 16 revolutions per minute about an axis that passes through the article, the nozzle means directing the jet of air at an angle relative to said axis in the range 10° to 45°.

8. Apparatus as claimed in claim 7, wherein a mould is provided to support the article on the stage.

9. Apparatus as claimed in claim 7, wherein a plurality of nozzles are provided at spaced locations.

10. Apparatus as claimed in claim 7, wherein at least one nozzle directs a jet of air onto the periphery of the ware.

11. Apparatus as claimed in claim 7, wherein a plurality of stages are provided on an endless conveyor passing below a plurality of nozzles arranged along the length of the conveyor in mutually spaced relationship.

12. Apparatus as claimed in claim 7, wherein the stage is a turntable that is supported for rotation about said axis.

13. A method of drying an article of ceramic ware comprising directing at least one jet of air onto the article at a predetermined temperature and pressure, and establishing relative rotation between the article and the jet at speeds of between 2 and 16 revolutions per minute, about an axis passing substantially through the center of the article, whereby the jet of air is directed onto the article at or near the periphery thereof in the direction of said axis.

14. A method as claimed in claim 13, wherein the predetermined temperature is in the range ambient to 300° C. and the predetermined pressure is in the range 50 kg/m$^2$ to 350 kg/m$^2$.

15. A method as claimed in claim 13, wherein the article is rotated relative to the jet about said axis.

16. A method as claimed in claim 13, wherein the jet is rotated relative to the article about said axis.

17. A method as claimed in claim 13, wherein the velocity of the jet lies in the range 10 inches/second to 800 inches/second.

* * * * *